United States Patent [19]

Armstrong

[11] 4,231,971

[45] Nov. 4, 1980

[54] FLOW METHOD AND DEVICE

[75] Inventor: Kenneth R. Armstrong, Lakewood, Calif.

[73] Assignee: Dresser Industries, Inc., Dallas, Tex.

[21] Appl. No.: 29,151

[22] Filed: Apr. 11, 1979

[51] Int. Cl.[3] ..... F02M 9/02

[52] U.S. Cl. ..... 261/44 B; 138/39; 261/DIG. 56; 261/DIG. 78; 415/DIG. 1

[58] Field of Search ..... 261/DIG. 78, 44 B, DIG. 56; 138/39; 60/264; 415/DIG. 1

[56] References Cited

U.S. PATENT DOCUMENTS

| | | | |
|---|---|---|---|
| 1,258,153 | 3/1918 | Shaw | 261/DIG. 78 |
| 3,599,431 | 8/1971 | Bonardi | 60/645 |
| 3,643,431 | 2/1972 | Jamieson | 138/39 |
| 3,778,038 | 12/1973 | Eversole et al. | 261/DIG. 78 |
| 4,029,430 | 6/1977 | Bonardi | 415/DIG. 1 |
| 4,034,028 | 7/1977 | Ma | 415/DIG. 56 |
| 4,049,758 | 9/1977 | Englert et al. | 261/DIG. 78 |
| 4,054,621 | 10/1977 | Bubniak et al. | 261/DIG. 78 |
| 4,098,073 | 7/1978 | Adkins et al. | 138/39 |
| 4,132,499 | 1/1979 | Igra | 415/DIG. 1 |
| 4,139,581 | 2/1979 | Swanson | 261/DIG. 78 |

FOREIGN PATENT DOCUMENTS

| | | | |
|---|---|---|---|
| 2714507 | 10/1977 | Fed. Rep. of Germany | 261/DIG. 78 |
| 141488 | 3/1961 | U.S.S.R. | 415/DIG. 1 |

*Primary Examiner*—Tim R. Miles

*Attorney, Agent, or Firm*—Connolly and Hutz

[57] ABSTRACT

A flow device and method delivers a gaseous medium to utilization equipment having variable pressure conditions at its intake. A gaseous medium intake zone connects with structure defining a variable area throat zone for constricting the flow of the gaseous medium to increase its velocity to sonic. Wall structure downstream from the throat zone provides a gradually diverging zone for efficiently recovering the kinetic energy of the high velocity gaseous medium as static pressure. Perforations are provided in the wall structure downstream and spaced from the throat zone, and these perforations connect on the back side of the wall structure with the intake of the utilization equipment. When supersonic flow occurs the high velocity mass moving past the perforations pulls a small portion of the gaseous medium already delivered to the intake of the utilization equipment into the gradually diverging zone. Such recirculated medium functions to disturb the supersonic flow and thereby shift the location of shock upstream from where it would otherwise occur to the location of the perforations.

8 Claims, 3 Drawing Figures

FLOW METHOD AND DEVICE

REFERENCE TO RELATED APPLICATION

This application is related to application Ser. No. 967,699, filed Dec. 8, 1978, entitled "Flow Device and Method", and the subject matter thereof is incorporated by reference in the present application.

BACKGROUND OF THE INVENTION

The present invention relates to a flow device and method, and more particularly to a flow device and method for lowering the exit velocity of a gaseous medium flowing through the device by shifting the location of shock upstream from where it would otherwise occur when the pressure ratio across the device is high.

U.S. Pat. No. 3,778,038 granted Dec. 11, 1973, explains a method and apparatus for producing a uniform combustible mixture of air and minute liquid fuel droplets for delivery to the intake manifold of an internal combustion engine. This apparatus includes an intake air zone connected to a variable area throat zone for constricting the flow of air to increase its velocity to sonic. Liquid fuel is introduced into the air stream to minutely divide and uniformly entrain fuel as droplets in the air flowing through the throat zone. Wall structure downstream from the throat zone is arranged to provide a gradually diverging zone for efficiently recovering a substantial portion of the kinetic energy of the high velocity air and fuel mixture as static pressure. Such efficient conversion enables the maintenance of sonic velocity air and fuel through the throat zone over substantially the entire operating range of the engine to which the air and fuel mixture is supplied.

As further explained in the above U.S. patent, during flow conditions when the pressure ratio across the apparatus is high, supersonic flow occurs and a shock results downstream from the throat zone. As this pressure ratio increases, the shock moves down the gradually diverging zone and further away from the throat zone. With even higher pressure ratios across the apparatus, the shock moves further down the gradually diverging zone. After shock under any conditions there is a tendency for the flow to separate from the walls of the gradually diverging zone. Usually the flow simply reattaches to the walls but when the shock is far down the gradually diverging zone, there is not sufficient wall space for such reattachment and an excessively high velocity jet is formed at the point of discharge from the apparatus.

The above U.S. patent also discloses that the device functions to control the mass flow of air being supplied to the engine since the air flow is maintained at sonic velocity through the throat zone over a wide range of engine conditions. Hence, under unvarying atmospheric conditions the mass flow rate of air being supplied to the engine is directly proportional to the cross-sectional area of the throat zone. Finally, as is apparent from the above U.S. patent, the liquid delivery means may be eliminated and the device used solely as a mass flow control for air or any gaseous medium.

The particular divergence of the wall structure downstream from the throat zone is extremely important in order to efficiently recover the kinetic energy of the high velocity mass as static pressure. As explained above, such efficient energy recovery enables sonic velocity at the throat zone over a wide range of downstream pressure conditions. However, the gradually diverging zone formed by the wall structure may be such that the exit velocity of the mass is excessive under the conditions mentioned above when the pressure ratio across the apparatus is high thereby causing shock to occur far down the gradually diverging zone. Then the flow does not reattach to the walls and a high velocity jet emerges from the apparatus. In carburetor applications, for example, excessive exit velocity from the air and fuel mixing device may cause the air and fuel mixture to impinge upon the manifold floor which prevents the mixture from being delivered to the cylinders of the engine in a homogeneous state.

SUMMARY OF THE INVENTION

Accordingly, an object of the present invention is a sonic flow device having structure that lowers the exit velocity of a gaseous medium flowing through the device when the pressure drop across the device is high while still preserving efficient recovery of the kinetic energy of the high velocity gaseous medium as static pressure when the pressure drop is low.

Another object of the present invention is a method for lowering the exit velocity from a sonic flow device when the pressure drop across the device is high while maintaining efficient recovery of the kinetic energy of the high velocity mass as static pressure when the pressure drop is low.

In accordance with the present invention, a device delivers a gaseous medium to utilization equipment having variable pressure conditions at its intake. The device comprises structure defining a gaseous medium intake zone connecting with a variable area throat zone for constricting the flow of the gaseous medium to increase its velocity to sonic. The area of the throat zone is adjustably varied in correlation with operating demands imposed upon the utilization equipment. Wall structure downstream from the throat zone is arranged to provide a gradually diverging zone for efficiently recovering a substantial portion of the kinetic energy of the high velocity gaseous medium as static pressure. The velocity of the gaseous medium through the throat zone is sonic over a wide range of pressure conditions at the intake of the utilization equipment. The improvement comprises perforations in the wall structure downstream and spaced from the throat zone. A passageway behind the wall structure interconnects the perforations with the exit from the gradually diverging zone for recirculating a portion of the gaseous medium to the perforations when supersonic flow occurs. Such recirculation functions to disturb the flow and thereby shift the location of shock upstream from where it would otherwise occur to the location of perforations when the pressure drop across the device is high.

The perforations may comprise an array of spaced apart circular holes each having a diameter of approximately one-eighth inch. Also, the length of the gradually diverging zone may be approximately two and one-half inches with the perforations spaced from the throat zone at least approximately one-half inch. The width of the diverging zone may be about three inches.

Liquid delivery structure may be provided for introducing liquid into the flow of the gaseous medium at or above the adjustable throat zone. In carburetor applications, the gaseous medium is air, the gaseous medium pressure at the entry to the intake zone is atmospheric, and the delivery structure introduces liquid fuel.

A method is also provided for delivering a gaseous medium at a controlled mass flow rate to utilization equipment having variable pressure conditions at its intake. In accordance with the invention, such methods includes the step of disturbing the flow of the gaseous medium through the gradually diverging zone at a location downstream and spaced from the throat zone to thereby shift the location of shock upstream from where it would otherwise occur when the pressure drop between the entry point and downstream end of the gradually diverging zone is high.

In this method the flow of the gaseous medium may be disturbed by recirculating a portion of the gaseous medium when supersonic flow occurs, and introducing such medium into the gradually diverging zone at a location downstream and spaced from the throat zone. Liquid may be introduced into the flow of the gaseous medium at or above the throat zone, and in carburetor applications, the gaseous medium is air and liquid fuel is introduced into the air flow.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE INVENTION

Figure 1:
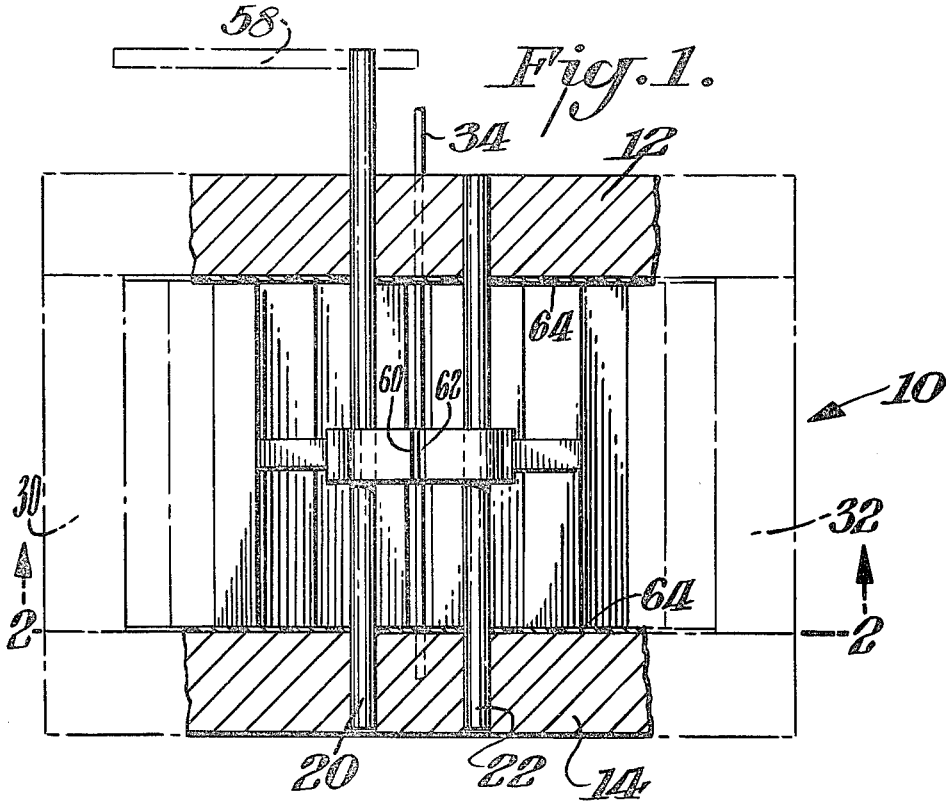
FIG. 1 is a top plan view of a fluid flow device, according to the present invention.
Figure 2:
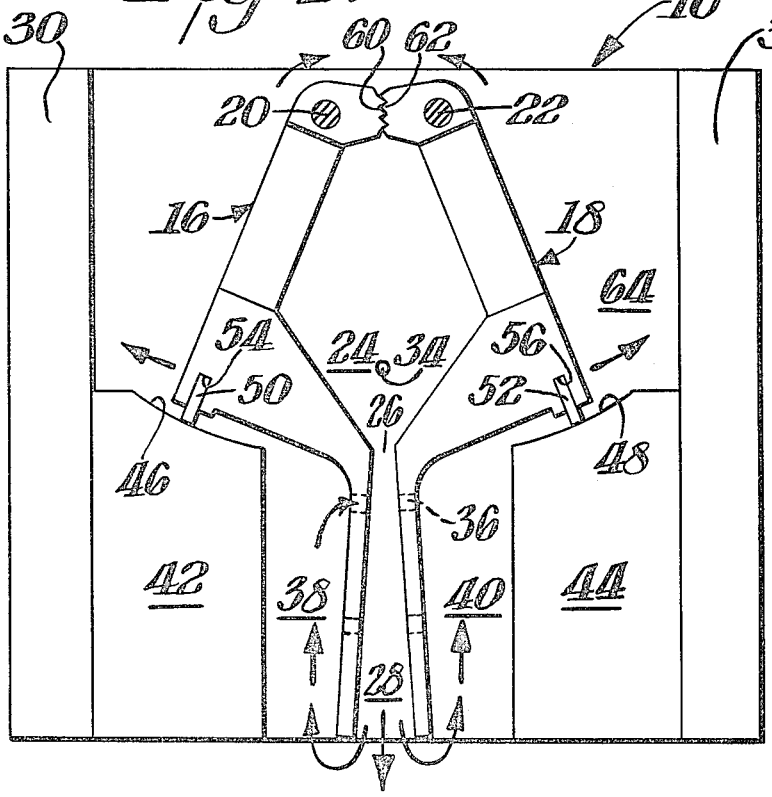
FIG. 2 is a sectional view taken along lines 2—2 of FIG. 1 with the surrounding structure shown in phantom outline.
Figure 3:
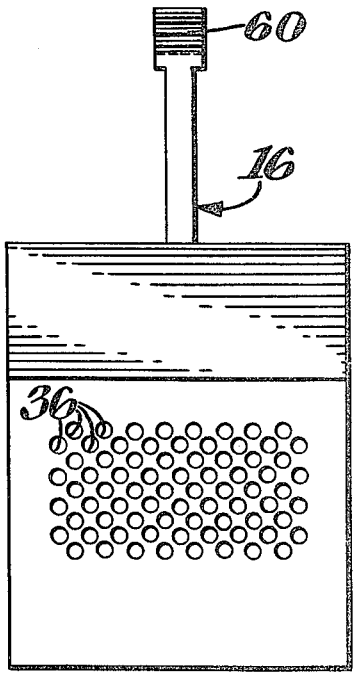
FIG. 3 is a front elevational view of one of the movable jaws shown in FIGS. 1 and 2.

Referring in more particularity to the drawings, FIGS. 1–3 illustrate a fluid flow device 10 for mixing and modulating liquid fuel and air in the production of a combustible air and liquid fuel mixture. While the device 10 is described for use in producing an air and fuel mixture, such device is equally capable of mixing and modulating other gaseous mediums besides air and other liquids besides fuel. Also, the liquid introduction structure of the device 10 may be eliminated and the so-modified device used as a mass flow control for a gaseous medium alone.

Generally, the device 10 illustrated in FIGS. 1–3 comprises an elongated housing with a central flow passageway therein. The passageway is defined by a pair of opposite spaced apart stationary slab walls 12,14 and a pair of opposite, spaced apart relatively movable jaw members 16,18. The movable jaw members are perpendicularly arranged between the stationary slab walls. The jaw members are essentially symmetrical in construction and supported opposite hand by rods 20,22 that extend between the stationary slab walls 12,14. The movable jaw members are anchored at their upper ends to the rods 20,22 and these members pivot about the axes of the rods, as explained more fully below.

The inner wall surfaces of the movable jaw members define a venturi cross-section therebetween. For the purpose of responding to engine demand, the jaw members 16,18 pivot about the axes of the rods 20,22 in order to increase and decrease the venturi flow area as required.

The passageway defined by the spaced apart opposite stationary slab walls 12,14 and the movable jaw members 16,18 includes a generally converging air entrance zone 24, a variable area throat zone 26, and a gradually diverging downstream zone 28. The stationary slab walls 12,14 together with housing end walls 30,32 may be secured to a rectangular base plate (not shown) having openings therein for securing the device 10 to the intake manifold of an internal combustion engine.

As explained above, the inside walls of the movable jaw members 16,18 define a venturi cross-section with the stationary slabs walls 12,14. This venturi cross-section includes the air entrance zone 24, the throat zone 26 and the gradually diverging downstream zone 28. Atmospheric air enters the mixing and modulating device 10 at the air entrance zone 24, and the air is accelerated to sonic velocity at the throat zone 26. Liquid fuel is introduced into the high velocity air stream at a fuel bar 34 upstream from the throat zone 26. The fuel bar 34 extends between and is supported by the stationary slabs 12,14, and a fuel source (not shown) is connected to the bar. The fuel bar includes openings therein through which the liquid fuel is introduced into the air stream. A valving or similar arrangement is provided in the fuel system to properly meter the quantity of fuel delivered to the fuel bar 34 in correlation with the operating demands of the engine with which the mixing and modulating device 10 is associated.

The sonic velocity air and liquid fuel mixture passes from the throat zone 26 into the gradually diverging downstream zone 28 where the kinetic energy of the high velocity air and fuel is efficiently recovered as static pressure. Such conversion enables the maintenance of sonic velocity air and fuel flow through the throat zone 26 over substantially the entire operating range of the engine. Thus, sonic velocity is achieved at the throat zone even at very low manifold vacuum levels.

In accordance with the invention, perforations 36 are provided in the movable jaw members 16,18 in the portion of each jaw which defines the gradually diverging zone 28. The perforations 36 are downstream and spaced from the throat zone 26, as shown best in FIGS. 2 and 3. Passageways 38,40 are located behind the perforations 36 and serve to interconnect them with the exit from the gradually diverging zone 28. In other words, the passageways 38,40 interconnect the perforations 36 with the intake manifold of the engine to which the air and fuel mixture is delivered. For reasons explained below, under supersonic flow conditions, a portion of the air and fuel mixture discharging from the gradually diverging zone 28 into the intake manifold is recirculated to and through the perforations by the action of the high velocity mass moving past those perforations.

As shown best in FIG. 2, the passageways 38,40 are defined in-part by blocks 42,44 secured to the end walls 30,32 and extending between the spaced apart stationary slab walls 12,14. The upper surface of each block includes an arcuate surface portion 46,48. The radius of the arcuate surface 46 has its origin at the axis of rod 20 while the axis of rod 22 is the origin for the radius of surface 48. Seals 50,52 fit within slots 54,56 in the jaws 16,18. The seals extend the width of the jaws and the free outer ends thereof are in engagement with the arcuate surface portions 46,48 as the jaws rotate about the axes 20,22. The blocks 42,44 together with the seals 50,52 and the back faces of the jaws 16,18 define the passageways 38,40.

Movement of the spaced apart jaw members 16,18 originates via a throttle linkage 58 which is operatively connected to the rod 20 supporting the jaw member 16. The throttle linkage 58 causes the rod 20 to rotate which in turn rotates the jaw 16 attached to the rod 20. Simultaneously, movement of the other jaw member 18 occurs via a pair of meshing gear segments 60,62 at the upper ends of the movable jaws. By operation of the throttle linkage 58, the jaw members 16,18 move toward and away from one another to vary the cross-sectional area of the throat zone in correlation with operating demands imposed upon the engine to which the mixture is delivered.

During flow conditions when the pressure ratio across the device 10 is just sufficient to produce sonic velocity at the throat zone 26, the velocity of the mixture immediately downstream from the throat zone is subsonic. The portion of the gradually diverging zone between the throat zone 26 and the start of the perforations 36 functions to efficiently recover a substantial portion of the high velocity air and fuel mixture as static pressure, and such efficient conversion enables the maintenance of sonic velocity through the throat zone even when the pressure drop across the device is quite small, i.e. very low manifold vacuum. Under these conditions, the pressure drop across the perforations is nil and little, if any, of the air and fuel mixture is recirculated into the gradually diverging zone through the perforations. However, as the manifold vacuum increases, the pressure ratio across the device also increases which results in supersonic flow and a shock zone downstream from the throat zone. As the pressure ratio further increases, the shock moves down the gradually diverging zone 28 and further away from the throat zone 26. With even higher pressure ratios across the device 10, the shock would ordinarily move further down the gradually diverging zone.

As explained above, after shock under any conditions there is a tendency for the flow to separate from the walls of the gradually diverging zone. Usually the flow simply reattaches to the walls, but if the shock is far down the gradually diverging zone, there is not sufficient wall structure remaining for such reattachment and an excessively high velocity jet is discharged at the exit. Flow jetting is an undesirable phenomena causing impaction of the air and fuel mixture upon the manifold floor. This results in poor cylinder-to-cylinder distribution of the mixture.

In the mixing and modulating device 10, the portion of the air and fuel mixture recirculated into the path of flow through the perforations 36 under supersonic conditions prevents flow jetting. The exit velocity from the device is sufficiently low under all conditions and the adverse effect of severe impaction on the manifold flow is substantially, if not completely, eliminated. The high velocity air and fuel mixture moving past the perforations 36 pulls a portion of the mixture which has already left the device into the flow. This recirculation results from the pressure drop across the perforations caused by the high velocity flow moving past the perforations. Such recirculation functions to disturb the flow and thereby shift the location of shock upstream from where it would otherwise occur to the location of the perforations when the pressure drop across the device is high. Under these conditions the supersonic and shock zone would normally extend far down the gradually diverging zone 28 but recirculation of the mixture through the perforations prevents this from occurring. Hence, the supersonic and shock zone is confined to the upper portion of the gradually diverging zone 28 which leaves sufficient wall structure downstream to allow the flow to reattach before delivery to the intake manifold.

Efficient energy recovery is not critical when the pressure ratio across the device 10 is high since such ratios provide sonic flow at the throat zone regardless of energy recovery. However, when the manifold vacuum is quite low, energy recovery is critical and the upper portion of the gradually diverging zone 28 then functions in an efficient manner to maintain sonic velocity at the throat zone 26.

The structure of the mixing and modulating device 10 also has an important secondary advantage in that by eliminating the high vacuum which would normally be created when the shock extended far down into the gradually diverging zone 26, large closing forces acting on the movable jaws 16,18 are avoided. The effect of the perforations and the recirculated flow greatly reduces these forces such that opening and closing of the device is accomplished very simply and without any noticeable effect on the throttle linkage 58 under all conditions.

Concerning the perforations 36, they may comprise an array of spaced apart circular holes each having a diameter of approximately one-eighth inch. The overall length of the gradually diverging zone 26 may be approximately two and one-half inches with the perforations spaced from the throat zone 24 at least approximately one-half inch and extending to about one inch from the exit of the device. The width of the diverging zone may be about three inches which results from jaws about three inches wide. When the overall dimensions of the jaws are varied, the size and location of the perforations may be proportionally varied.

Also, if desired, the inside face of the slabs 12,14 may be coated with antifriction material 64, such as polytetrafluoroethylene, to prevent wear and seal the side edges of the movable jaws 16,18 as they move toward and away from one another to modulate the flow.

What is claimed:

1. In a device for delivering a gaseous medium to utilization equipment having variable pressure conditions at its intake comprising, in combination, means defining a gaseous medium intake zone connecting with means defining a variable area throat zone for constricting the flow of the gaseous medium to increase the velocity thereof to sonic, means for adjustably varying the area of the throat zone in correlation with operating demands imposed upon the utilization equipment, wall means downstream from the throat zone arranged to provide a gradually diverging zone for efficiently recovering a substantial portion of the kinetic energy of the high velocity gaseous medium as static pressure whereby the velocity of the gaseous medium through the throat zone is sonic over a wide range of pressure conditions at the intake of the utilization equipment, the improvement comprising perforations in the wall means downstream and spaced from the throat zone and upstream and spaced from the exit of the gradually diverging zone, and passageway means behind the wall means interconnecting the perforations with the exit from the gradually diverging zone for recirculating a portion of the gaseous medium from the exit of the diverging zone to the perforations to thereby disturb the flow and shift the location of shock upstream from where it would otherwise occur to the location of the perforations when the pressure drop across the device is high.

2. The combination of claim 1 in which the perforations comprise an array of spaced apart circular holes each having a diameter of approximately one-eighth inch.

3. The combination of claim 1 in which the length of the gradually diverging zone is approximately two and one-half inches and the width thereof is approximately three inches, and in which the perforations are spaced from the throat zone at least approximately one-half inch.

4. The combination of claim 1 including liquid delivery means for introducing liquid into the flow of the gaseous medium at or above the adjustable throat zone.

5. The combination of claim 4 in which the gaseous medium is air, the gaseous medium pressure at the entry to the intake zone is atmospheric, and the delivery means introduces liquid fuel.

6. In a method for delivering a gaseous medium at a controlled mass flow rate to utilization equipment having variable pressure conditions at its intake comprising the steps of flowing a gaseous medium stream from an entry point, passing the gaseous medium through a variable area throat zone to increase the velocity thereof to sonic, adjustably varying the area of the throat zone in correlation with operating demands imposed upon the utilization equipment, passing the gaseous medium immediately downstream from the variable area throat zone through a gradually diverging zone to gradually reduce the velocity thereof and efficiently recover the kinetic energy thereof as static pressure whereby the velocity of the gaseous medium through the throat zone is sonic over a wide range of pressure conditions at the intake of the utilization equipment, the improvement comprising disturbing the flow of the gaseous medium along the surface of the gradually diverging zone by recirculating a portion of the gaseous medium and introducing it into the flow at a location downstream and spaced from the throat zone and upstream and spaced from the exit of the gradually diverging zone to thereby shift the location of shock upstream from where it would otherwise occur when the pressure drop between the entry point and downstream end of the gradually diverging zone is high.

7. The method of claim 6 including the step of introducing liquid into the flow of the gaseous medium at or above the variable area throat zone.

8. The method of claim 7 in which the gaseous medium is air and liquid fuel is introduced into the flow of the air.

* * * * *